US012291391B2

(12) United States Patent
Lee

(10) Patent No.: US 12,291,391 B2
(45) Date of Patent: May 6, 2025

(54) REFILLABLE DISPENSING CONTAINER AND REFILL CONTAINER

(71) Applicant: SAMHWA CO., LTD, Uiwang-si (KR)

(72) Inventor: Kyungchang Lee, Uiwang-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 281 days.

(21) Appl. No.: 18/126,474

(22) Filed: Mar. 26, 2023

(65) Prior Publication Data

US 2024/0140683 A1 May 2, 2024

(30) Foreign Application Priority Data

Oct. 28, 2022 (KR) ..... 10-2022-0140819

(51) Int. Cl.
*B65D 83/00* (2006.01)
*B65D 77/04* (2006.01)
*B65D 83/767* (2025.01)

(52) U.S. Cl.
CPC ..... *B65D 83/767* (2025.01); *B65D 77/0486* (2013.01); *B65D 2577/041* (2013.01)

(58) Field of Classification Search
CPC ..... B65D 83/767; B65D 77/0486; B65D 2577/041; B65D 25/02; B65D 39/00; B65D 41/04; B65D 51/18; A45D 40/0075; A45D 2200/055; B05B 11/0037; B05B 11/02; B05B 11/0054; B05B 11/0038; B05B 11/1001; B05B 11/1053
See application file for complete search history.

(56) References Cited

U.S. PATENT DOCUMENTS 7,140,518 B2 * 11/2006 Wang ..... B05B 9/0838 222/326
11,084,646 B1 * 8/2021 Hwang ..... B05B 11/0008
2016/0324294 A1 * 11/2016 Kim ..... B05B 11/1097
2018/0290161 A1 * 10/2018 Lee ..... B05B 11/0037
2021/0345754 A1 * 11/2021 Hwang ..... A45D 34/04

FOREIGN PATENT DOCUMENTS

KR 200347811 Y1 * 4/2004
KR 101422069 B1 * 7/2014
KR 101958149 B1 * 3/2019
KR 20210006762 A * 1/2021

* cited by examiner

*Primary Examiner* — Bob Zadeh
(74) *Attorney, Agent, or Firm* — Park, Kim & Suh, LLC

(57) ABSTRACT

A refillable dispensing container and a refill container are disclosed. The refillable dispensing container includes: an outer container having an open top and a holding space; an inner container having an open top and inserted within the holding space; a holder that includes a holder body and a support protrusion; an inner cap which has a cap channel and is configured to be detachably coupled to the open top of the outer container; a shoulder having a through-hole and coupled to an outer side of the inner cap; a button having a dispensing hole and coupled to the through-hole of the shoulder such that the button is movable along a vertical direction; and a pump module arranged adjacently to the holder channel and the cap channel, where the pump module is configured to dispense a content out of the dispensing hole when the button is pressed.

8 Claims, 12 Drawing Sheets

REFILLABLE DISPENSING CONTAINER AND REFILL CONTAINER

CROSS-REFERENCE TO RELATED APPLICATIONS

This application claims the benefit of Korean Patent Application No. 10-2022-0140819, filed with the Korean Intellectual Property Office on Oct. 28, 2022, the disclosure of which is incorporated herein by reference in its entirety.

BACKGROUND

1. Technical Field

The present invention relates to a dispensing container, more particularly to a refillable dispensing container and a refill container that allow easy replacing of the refill container and convenient recycling.

2. Description of the Related Art

With growing societal awareness of how much the environment is being polluted, there is an increase in demand for products that are easy to recycle and reuse. It is possible to make a dispensing container, for example, easier to recycle by manufacturing the entire container from the same material, such as by using a spring fabricated by plastic molding instead of the metal spring traditionally used in the pump. Also, by manufacturing a dispensing container such that certain components are replaceable for refilling, it would be possible to lower costs and reduce waste.

Another aspect of reducing waste can include completing using up the content of a container. For example, if some content were to be left remaining in a replaced refill container, there would be a waste of resources in that the remaining content is disposed of, but since such a container cannot be recycled as is, there would be an additional waste of resources resulting from having to open and clean the container.

Certain considerations should be taken into account in the design of the refill container also, since a refill container having an excessively simple composition can be difficult to mount, and the dispensing container mounted with the refill container may not provide a high performance. If, in order to compensate, the refill container is given a more complicated composition, the cost of manufacturing the refill container would be increased, which in turn can incur a waste of resources. Thus, there is a need for a refillable dispensing container and a refill container that allow an easy replacing of the refill container, so as to promote active use by consumers, allow the refill container to have a simple composition, and also allow the refillable dispensing container to maintain a high performance.

SUMMARY OF THE INVENTION

An aspect of the invention, which was conceived to resolve the problem described above, is to provide a refillable dispensing container and a refill container that allow easy replacing of the refill container and convenient recycling.

Another aspect of the invention is to provide a refillable dispensing container and a refill container that can minimize the amount of unused content remaining in the container and simplify the procedure of cleaning the container for recycling.

Yet another aspect of the invention is to provide a refillable dispensing container and a refill container that allow the refill container to have a simple composition while also allowing the refillable dispensing container to maintain a high performance.

Other objectives of the present invention will be more clearly understood from the embodiments set forth below.

One aspect of the invention provides a refillable dispensing container that includes: an outer container which has an open top and a holding space formed therein; an inner container which has an open top and a storage space is formed therein and is configured to be inserted within the holding space; a holder that includes a holder body and a support protrusion, where the holder is coupled to the open top of the inner container, a holder channel is formed in the holder body, the holder channel vertically penetrates the holder body, and the support protrusion protrudes upward from an upper surface of the holder body; an inner cap which has a cap channel formed therein and is configured to be detachably coupled to the open top of the outer container, where the cap channel vertically penetrates the inner cap and is formed in a position corresponding to the holder channel, and the inner cap is configured to press the holder against the inner container while the inner cap is coupled to the outer container; a shoulder, in an upper portion of which a through-hole is formed, where the shoulder is coupled to an outer side of the inner cap; a button, in an upper portion of which a dispensing hole is formed, where the button is coupled to the through-hole of the shoulder such that the button is movable along a vertical direction and a portion of the button passes through the through-hole; and a pump module arranged adjacently to the holder channel and the cap channel, where the pump module includes an elastic member to elastically support the button in relation to the inner cap, and the pump module is configured to dispense a content stored in the storage space out of the dispensing hole when the button is pressed.

A refillable dispensing container according to an embodiment of the invention can include one or more of the following features. For example, the holder can include a holder-protruding portion that protrudes in at least one of an upward and a downward direction from the holder body to form the holder channel therein, where the inner diameter of the holder-protruding portion can decrease towards the bottom of the holder-protruding portion. Also, the inner cap can include a cap-protruding portion that protrudes in at least one of an upward and a downward direction from the cap body to form the cap channel therein, where the inner diameter of the cap-protruding portion can decrease towards the bottom of the cap-protruding portion.

The refillable dispensing container can further include a piston that is arranged under the content within the storage space of the inner container and is configured to contact the inner perimeter of the inner cap in a watertight manner, where the piston can move upward within the storage space as the content is dispensed. In such cases, the piston can include: a piston body; a recessed portion that is recessed downward from the piston body; and a contact portion that is formed on the outer perimeter of the piston body, where the recessed portion can have a shape corresponding to the portions of the holder, the inner cap, and the pump module that protrude below the lower surface of the holder body.

The inner container can include a flange that is configured to rest on an upper portion of the outer container, and the outer perimeter and the lower surface of the inner container can be configured not to contact the outer container. In such cases, a curb can be formed on the inner side of the upper end of the outer container, and the flange of the inner container can rest on the curb such that the lower surface and the outer perimeter of the flange contacts the outer container.

Another aspect of the invention provides a refill container for the refillable dispensing container above. The refill container may include: the inner container; the holder; and a refill cap configured to be coupled to the holder, where the refill cap may include: a flat plate having a shape corresponding to the holder; a first plug protruding downward from a lower surface of the flat plate at a position corresponding to the holder channel so as to block the holder channel while the refill cap is coupled to the holder; a second plug protruding downward from the lower surface of the flat plate at a position adjacent to the support protrusion of the holder so as to contact a side surface of the support protrusion while the refill cap is coupled to the holder; and a grip portion protruding upward from an upper surface of the flat plate.

An embodiment of the present invention having the features above can provide various advantageous effects including the following. However, an embodiment of the present invention may not necessarily exhibit all of the effects below.

An embodiment of the invention can provide a refillable dispensing container and a refill container that can reduce wasted resources by allowing convenient recycling and easy replacing and also by allowing a complete expending of the content within each refill unit.

Also, a refillable dispensing container and a refill container according to an embodiment of the invention can maintain a high performance while allowing easy replacing of the refill container.

DETAILED DESCRIPTION OF THE INVENTION

Figure 1A:
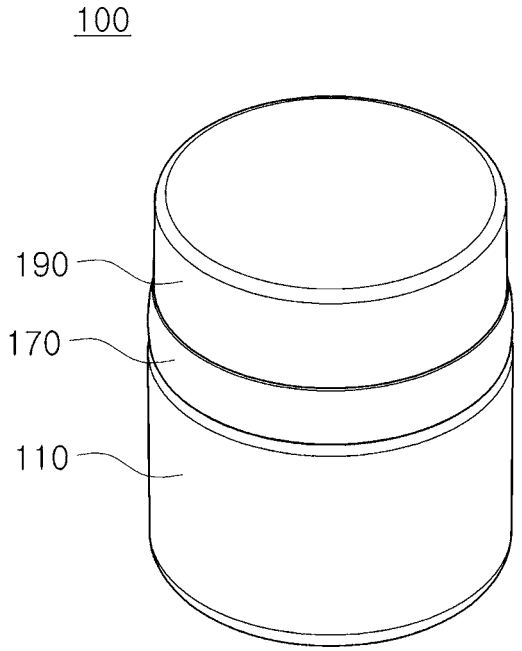
FIG. 1A and FIG. 1B are perspective views illustrating a refillable dispensing container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 1B:
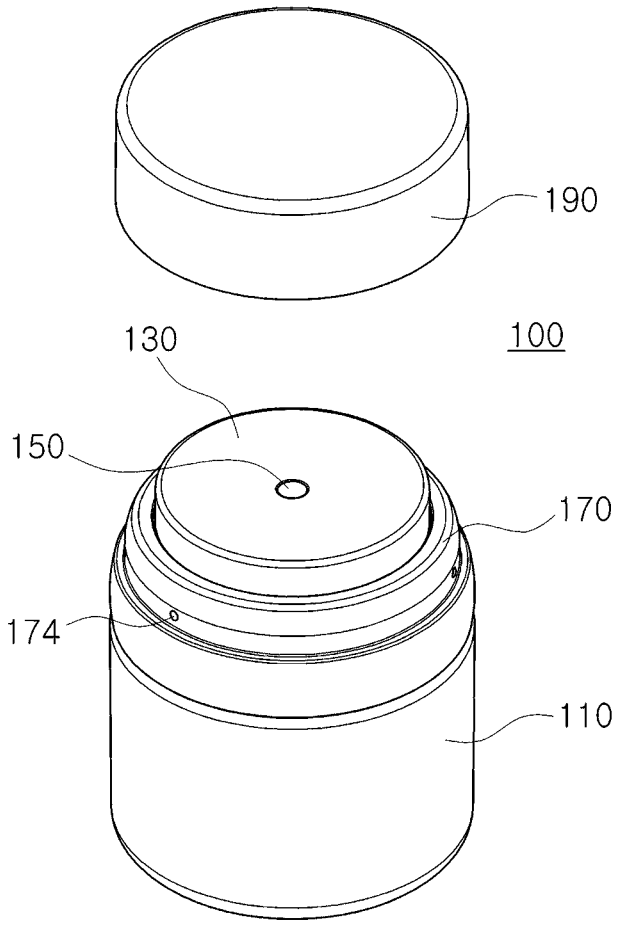
Figure 2:
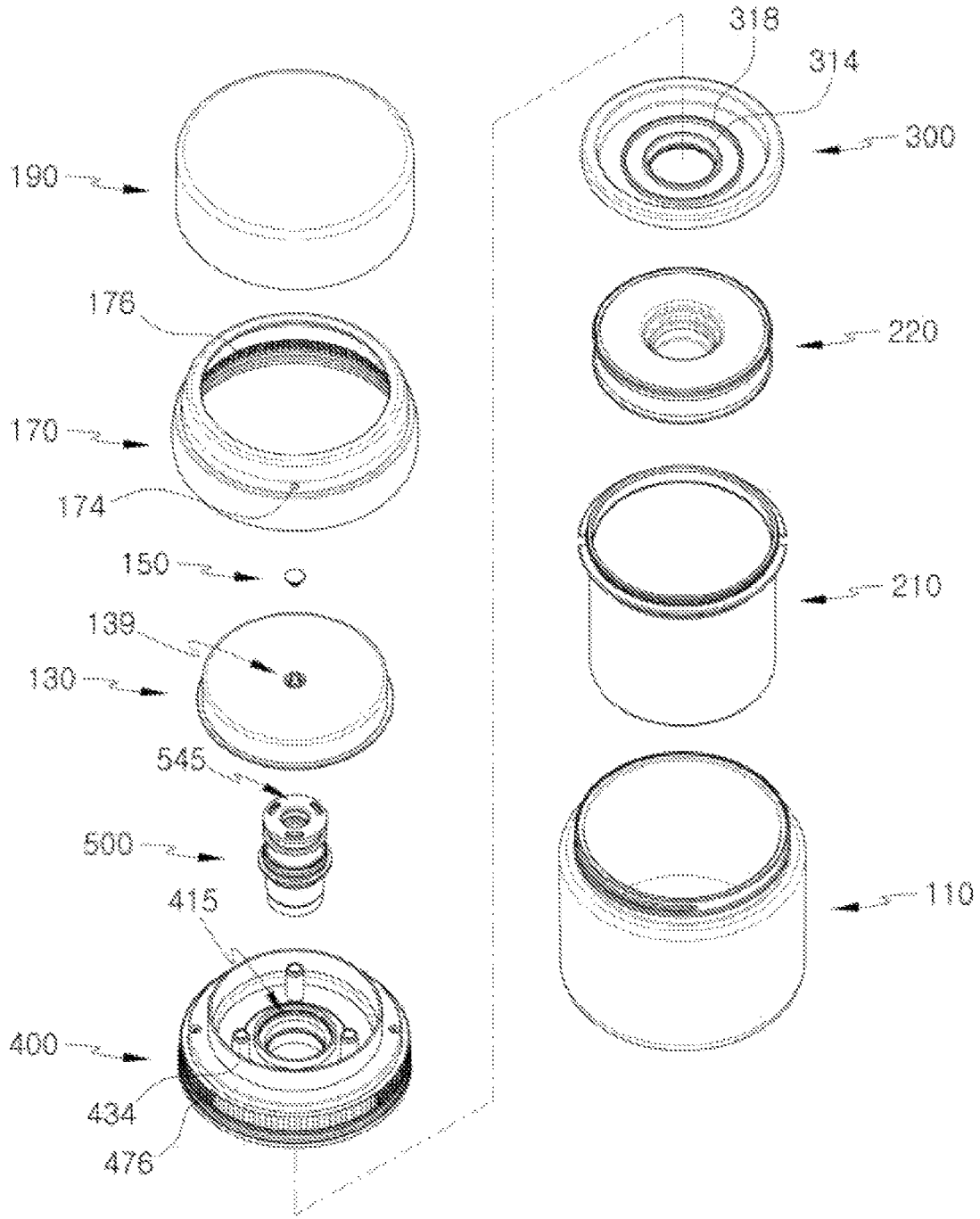
FIG. 2 is an exploded perspective view illustrating a refillable dispensing container according to an embodiment of the invention.
Figure 3:
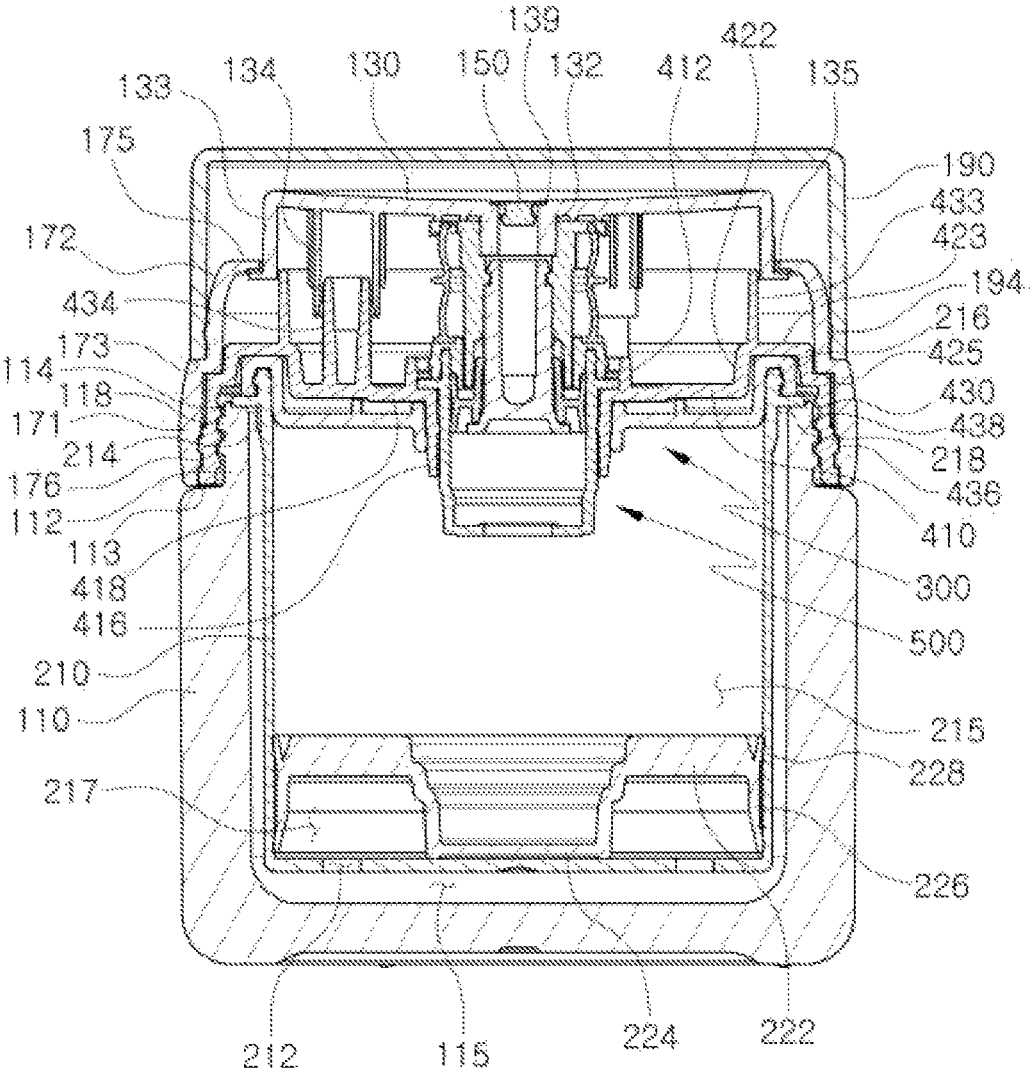
FIG. 3 is a cross-sectional view illustrating a refillable dispensing container according to an embodiment of the invention.
Figure 4A:
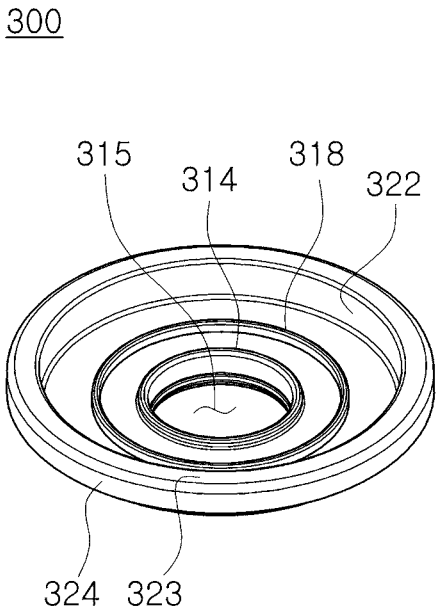
FIG. 4A and FIG. 4B are perspective views illustrating the holder of a refillable dispensing container according to an embodiment of the invention.
Figure 4B:
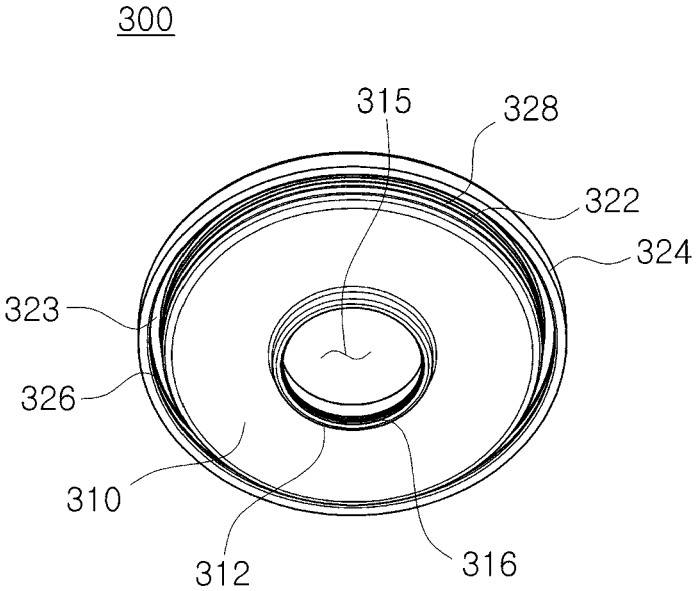
Figure 5:
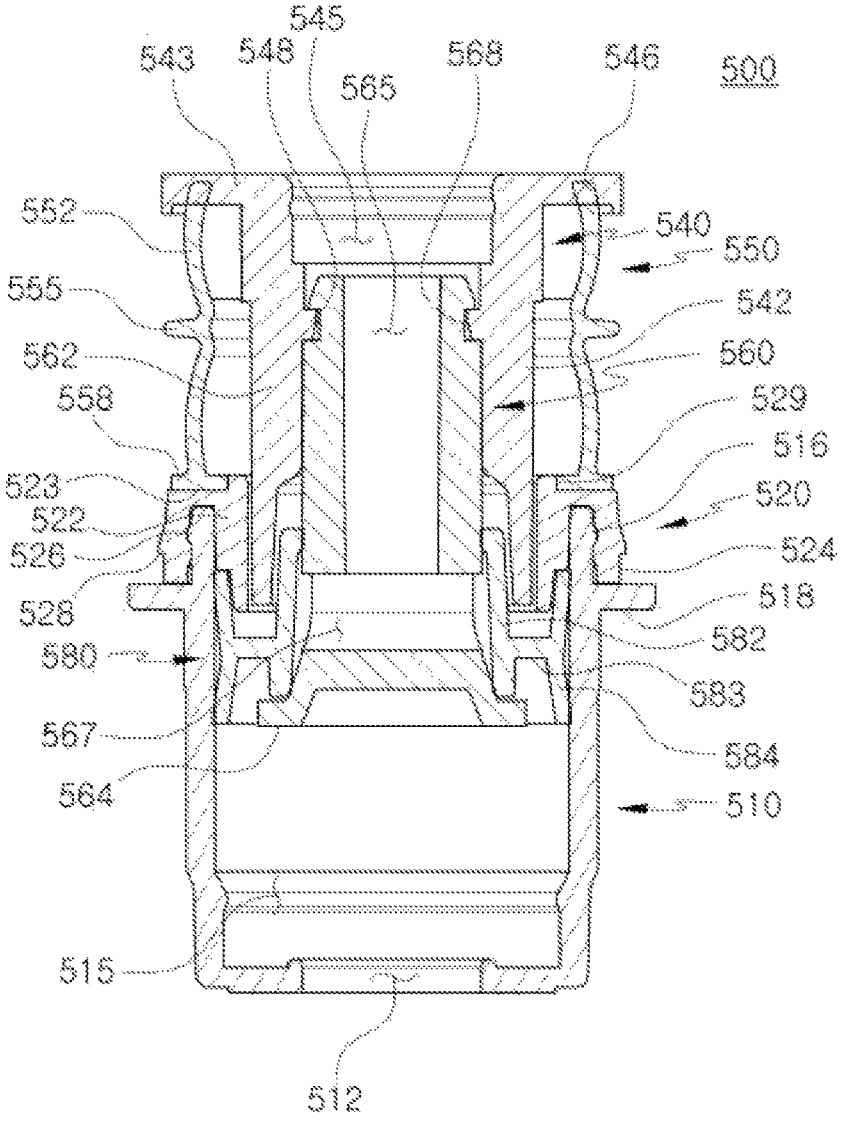
FIG. 5 is a cross-sectional view illustrating the pump module of a refillable dispensing container according to an embodiment of the invention.

FIG. 1A and FIG. 1B are perspective views illustrating a refillable dispensing container 100 according to an embodiment of the invention, while FIG. 2 and FIG. 3 are an exploded perspective view and a cross-sectional view illustrating a refillable dispensing container 100 according to an embodiment of the invention, respectively. FIG. 4A and FIG. 4B are perspective views illustrating the holder 300 of a refillable dispensing container 100 according to an embodiment of the invention, while FIG. 5 is a cross-sectional view illustrating the pump module 500 of a refillable dispensing container 100 according to an embodiment of the invention.

Referring to FIG. 1A through FIG. 5, a refillable dispensing container 100 according to an embodiment of the invention can mainly include an outer container 110, an inner container 210, a piston 220, a holder 300, an inner cap 400, a pump module 500, a button 130, a valve 150, a shoulder 170, and an overcap 190. First, a general overview of these components of the refillable dispensing container 100 is provided below in the order listed above.

The outer container 110 may be a part having a holding space 115 that opens toward its top formed on the inside. The outer container 110 can serve to house the inner container 210, which may be inserted in the holding space 115. In an embodiment of the invention, the outer container 110 can be made from a glass or a transparent plastic material, but the invention is not limited by the material of the outer container 110.

In the example illustrated in FIG. 1A through FIG. 3, a narrowed portion 112 having a smaller outer diameter is formed at the upper portion of the outer container 110. The narrowed portion 112 may make it easier to couple the inner cap 400 onto the outer container 110. A male thread 118 can be formed on the outer perimeter of the narrowed portion 112, as in the illustrated example. Since the narrowed portion 112 can have a diameter that is smaller than the outer diameter of the remaining portions of the outer container 110, a curb 113 can be formed under the narrowed portion 112.

The inner container 210 can be inserted inside the outer container 110, and an upper portion of the inner container 210 can rest on an upper portion of the outer container 110. In cases where a flange 218 is provided at an upper portion of the inner container 210, such as in the illustrated example, an L-shaped curb 114 can be formed on the inner side of the upper end of the outer container 110 in a size corresponding to the size of the flange 218, and the flange 218 of the inner container 210 can be configured to rest on the curb 114 such that the lower surface and outer perimeter of the flange 218 contact the curb 114 of the outer container 110.

The inner container 210 may be a part that is inserted within the holding space 115 of the outer container 110. A storage space 215 that opens towards its top can be formed on the inside of the inner container 210, where a content (not shown) that is prepared for dispensing by the refillable dispensing container 100 can be stored in the storage space 215. A substance such as a gel, cream, foam, etc., that is not runny can be suitable as the content, but the invention is not limited by the type of the content. Also, while an embodiment can have an inner container 210 made from a plastic material such as PP (polypropylene), etc., the invention is not limited by the material of the inner container 210.

In order that the inner container 210 may be readily inserted within the outer container 110, the outer diameter of the inner container 210 can be smaller than or equal to the inner diameter of the holding space 115 portion of the outer container 110, and preferably, the outer diameter of the inner container 210 can be smaller than the inner diameter of the holding space 115 portion of the outer container 110. In such cases, the inner container 210 can be configured such that its outer perimeter and lower surface are not in contact with the outer container 110, as in the example illustrated in FIG. 3.

In cases where a piston 220 is provided in the storage space 215 of the inner container 210, ventilation holes 212 can be formed in a lower portion of the inner container 210. The piston 220 can block the movement of the content and the air within the storage space 215. For convenience, the space under the piston 220 within the interior space (storage space 215) of the inner container 210 will be referred to herein as the ventilated space 217. The ventilation holes 212 can provide communication between the outside and inside of the inner container 210. That is, the ventilation holes 212 can connect the space between the outer container 110 and the inner container 210 with the ventilated space 217 of the inner container 210. The inner container 210 may store the content, but, as described later on, the piston 220 can first be arranged in the storage space 215, and the content can be injected only in the space above the piston 220. As the ventilation holes 212 are positioned below the piston 220, and the piston 220 prevents any leakage of the content, there is no risk of the content leaking through the ventilation holes 212.

At an upper portion of the inner container 210, a reinforced part 214 can be formed, which may have a greater thickness. The inner container 210 may be coupled with the outer container 110 and the holder 300 at the upper portion, and the reinforced part 214 can have an increased thickness so as to provide a greater strength and a firmer coupling force at the corresponding portion. A detent protrusion 216 can be formed at an upper portion of the reinforced part 214. The detent protrusion 216 can be configured to be caught in the detent groove 326 (see FIG. 4A) of the holder 300 to cooperate in providing a high coupling force between the inner container 210 and the holder 300.

The inner container 210 can also include a flange 218 that is configured to rest on an upper portion of the outer container 110. In cases where the outer diameter of the inner container 210 is smaller than the inner diameter of the outer container 110, the flange 218 can be placed on the upper end of the outer container 110 to thereby keep the inner container 210 in its designed position. As described above, an L-shaped curb 114 can be formed at the upper end of the outer container 110, and the flange 218 can rest on the curb 114. The L-shaped curb 114 can support the lower surface of the flange 218 and at the same time can contact the outer perimeter of the flange 218 as well, to aid in aligning the inner container 210 at its proper position with respect to the outer container 110.

In the example illustrated in FIG. 3, the thickness of the reinforced part 214 is increased such that the outer diameter is increased, and the detent protrusion 216 is also formed on the outer perimeter of the reinforced part 214. This allows the inner perimeter of the inner container 210 to maintain a smooth surface, thereby allowing an easier inserting of the piston 220 and holder 300 and also allowing a tight contact between the inner container 210 and the holder 300 for preventing any leakage of the content. However, in cases where the edges of the piston 220 are made from a soft material, and if there is no great risk of leakage between the holder 300 and the inner container 210, it is possible to increase the thickness of the reinforced part 214 by decreasing the inner diameter, and it is likewise possible to form the detent protrusion 216 on the inner perimeter of the reinforced part 214.

The piston 220 can be inserted within the storage space 215 of the inner container 210 and can serve to push the content (not shown) towards the pump module 500. For example, in cases where the content is stored in the storage space 215 of an inner container 210 that does not include a piston 220 and has the ventilation holes 212 formed in other locations, continued dispensing of the content by the pump module 500 would cause the level of the content to gradually move down within the storage space 215, and the pump module 500 would require drawing the content up from the lower part of the storage space 215 by way of a tube, etc.

In contrast, in cases where a piston 220 is provided and where the ventilation holes 212 are formed in a lower portion of the inner container 210, continued dispensing of the content by the pump module 500 would lower the internal pressure in the sealed space above the piston 220 within the storage space 215, and the negative pressure would cause the piston 220 to move up. As the piston 220 moves upward, air can enter the space below the piston 220 through the ventilation holes 212 in the lower portion of the inner container 210. Since the content cannot move below the piston 220, the upper portion of the storage space 215 may always be kept full of the content, and there would be no occurrences in which the pump module 500 is unable to dispense the content.

According to an embodiment of the invention, the piston 220 can include a piston body 222, a recessed portion 224, and a contact portion 226. In an embodiment of the invention, the piston 220 can be made from a plastic material such as PE (polyethylene), etc., but the invention is not limited by the material of the piston 220.

The piston body 222, forming the main body of the piston 220, can be implemented in a generally flat form and can be designed to have a thickness that is suitable in consideration of the weight and required strength of the piston 220.

The recessed portion 224 may correspond to a portion that is recessed downward from the piston body 222. The recessed portion 224 can be formed in a position corresponding to the position of the pump module 500. In one embodiment of the invention, the recessed portion 224 can have a shape corresponding to the portions of the holder 300, inner cap 400, and pump module 500 that protrude below the lower surface of the holder body 310 of the holder 300 (see FIG. 4B) described later on.

As the content in the storage space 215 is consumed, the piston 220 will move up within the storage space 215. In a preferred embodiment of the invention, when the piston 220 reaches its greatest height possible, the portions of the holder 300, inner cap 400, and pump module 500 that protrude below the lower surface of the holder body 310 can be inserted in the recessed portion 224, while the upper surface of the piston body 222 can contact the lower surface of the holder body 310. Thus, when the content is almost completely expended, the remainder of the content may all be positioned within the recessed portion 224, so that the pump module 500 can be supplied with the content in a normal fashion until the very end.

The contact portions 226, 228 may be formed on the outer perimeter of the piston body 222 and can be configured to tightly contact the inner perimeter of the inner container 210. In the example illustrated in FIG. 3, the contact portions 226, 228 include a lower contact portion 226 and an upper contact portion 228. The contact portions 226, 228 can be formed with a small thickness so as to be capable of slight elastic deformations, thus allowing the contact portions 226, 228 to contact the inner perimeter of the inner container 210 without letting the content or air pass through.

The lower contact portion 226 can extend downward from the piston body 222 and can extend to a height corresponding to the lower surface of the recessed portion 224, as in the illustration of FIG. 3. The lower contact portion 226 can have an outer diameter that increases towards the bottom so as to strongly press against the inner perimeter of the inner container 210. Of course, in certain embodiments, the lower contact portion 226 can extend to a position that is higher than the height corresponding to the lower surface of the recessed portion 224. Similarly, the upper contact portion 228 can extend upward from the piston body 222 and can extend to a height corresponding to the upper surface of the piston body 222, as in the illustration of FIG. 3. The upper contact portion 228 can have an outer diameter that increases towards the top so as to strongly press against the inner perimeter of the inner container 210. Of course, in certain embodiments, the upper contact portion 228 can extend to a position that is lower than the height corresponding to the upper surface of the piston body 222. In certain embodiments, either one of the lower contact portion 226 and the upper contact portion 228 can be omitted. Also, in certain embodiments, the piston 220 itself can be omitted, substituted instead by a tube (not shown), etc., coupled to the pump module 500.

The holder 300 may be the part coupled to the open top of the inner container 210 and can have a holder channel 315 formed therein that penetrates the holder 300 vertically. The pump module 500 can be mounted at a position adjacent to the holder channel 315 so as to be supplied with the content from the storage space 215 through the holder channel 315. In certain embodiments, the holder 300 can be made from a plastic material such as PP (polypropylene), etc., and can be made from the same material as that of the inner container 210. However, the invention is not limited by the material of the holder 300. Referring to FIGS. 4A and 4B, the holder 300 can mainly include a holder body 310, holder-protruding portions 312, 314, a support protrusion 318, a side wall 322, a rim 323, and a peripheral element 324.

The holder body 310 can have a generally flat shape and can form the main body of the holder 300. At a designated position of the holder body 310, a holder channel 315 can be formed that penetrates the holder body 310 vertically.

A holder-protruding portion 312, 314 can be formed around the holder channel 315, protruding in at least one of an upward and a downward direction and forming the holder channel 315 on the inside. In the example illustrated in the drawings, the holder 300 includes a lower holder-protruding portion 312 that extends downward from the holder body 310 and an upper holder-protruding portion 314 that extends upward from the holder body 310, where the holder-protruding portions 312 are formed in a continuous shape. That is, the holder-protruding portions 312, 314 can form a tube shape that extends a particular distance in the upward and downward directions, where the inside of the tube shape can correspond to the holder channel 315. In a preferred embodiment of the invention, the holder-protruding portions 312, 314 can have inner diameters that decrease towards the bottom. That is, the holder channel 315 can become narrower towards the bottom. A groove 316 can be formed in the inner perimeter of the holder-protruding portions 312, 314 to aid in providing an airtight seal.

The support protrusion 318 can protrude upward by a particular length from the upper surface of the holder body 310. As illustrated in FIG. 4A, the support protrusion 318 can be formed in a continuous arrangement to form an annular shape that surrounds the holder channel 315. The support protrusion 318 can protrude to a length sufficient to contact the inner cap 400 that is coupled to an upper portion of the holder 300 or to a shorter length.

The side wall 322 can protrude upward by a particular length from an outer side of the holder body 310. The rim 323 can protrude outward along a horizontal direction from an upper portion of the side wall 322, and the outer peripheral element 324 can protrude downward by a particular length from an outer side of the rim 323. Due to this structure, a gap can be formed between the side wall 322 and the peripheral element 324, and an upper portion of the inner container 210 can be inserted and coupled in this gap.

A detent groove 326 can be formed in the inner perimeter of the peripheral element 324, and the detent protrusion 216 of the inner container 210 can be inserted in the detent groove 326 of the peripheral element 324. The detent protrusion 216 and the detent groove 326 can aid in strengthening the coupling between the inner container 210 and the holder 300 and strengthening the sealing of the storage space 215.

A sealing protrusion 328 can be formed on the outer perimeter of the side wall 322. When the holder 300 is coupled to the inner container 210, the sealing protrusion 328 can undergo a slight elastic deformation by the pressure and thus increase the sealing performance at the corresponding position.

The inner cap 400 can cover the upper portion of the holder 300 and can be separably coupled to the open top of the outer container 110. A cap channel 415 that penetrates the inner cap 400 can be formed in a position corresponding to the holder channel 315, and the pump module 500 can be coupled to the cap channel 415. In certain embodiments, the inner cap 400 can be made from a plastic material such as PP (polypropylene), etc., and can be made from the same material as that used for the inner container 210 and/or the holder 300. Of course, however, the invention is not limited by the material of the inner cap 400. Referring to FIGS. 2 and 3, the inner cap 400 can mainly include a cap body 410, a cap-protruding portion 416, a main side wall 422, a rim 423, a peripheral element 430, a support side wall 433, and support shafts 434.

The cap body 410 can have a generally flat shape and can form the main body of the inner cap 400. At a designated position of the cap body 410, a cap channel 415 can be formed that penetrates the cap body 410 vertically, where the cap channel 415 can be formed in a position corresponding to the holder channel 315 of the holder 300.

An alignment protrusion 412 can be formed on the cap body 410. The alignment protrusion 412 can protrude upward by a particular length from the upper surface of the cap body 410 at a position corresponding to the position where the pump module 500 is to be installed. The alignment protrusion 412 can serve to align the pump module 500 at its correct position and can also aid in sealing the pump module 500.

The cap-protruding portion 416 can be formed around the cap channel 415, protruding in at least one of an upward and a downward direction and forming the cap channel 415 on the inside. In the example illustrated in the drawings, the inner cap 400 includes a cap-protruding portion 416 that extends downward from the cap body 410. The cap-protruding portion 416 can form a tube shape that extends a particular distance along the upward and downward directions, where the inside of the tube shape can correspond to the cap channel 415. In a preferred embodiment of the invention, the cap-protruding portion 416 can have an inner diameter that decreases towards the bottom. That is, the cap channel 415 can become narrower towards the bottom. A groove can be formed in the outer perimeter and/or the inner perimeter of the cap-protruding portion 416 to aid in providing an airtight seal.

When the pump module 500 is inserted through the inside of the cap-protruding portion 416, the inner perimeter of the cap-protruding portion 416 can tightly contact the outer perimeter of the pump cylinder 510. In particular, since the inner perimeter of the cap-protruding portion 416 and the outer perimeter of the pump cylinder 510 engage in surface contact over a considerable length, a very tight seal can be formed at this area.

As illustrated in FIG. 3, when the inner cap 400 is arranged over the holder 300, the cap-protruding portion 416 can be tightly pressed against the inner perimeters of the holder-protruding portions 312, 314 of the holder 300. For an even stronger seal, a sealing member (not shown) can be additionally provided between the holder-protruding portions 312, 314 and the cap-protruding portion 416, where the sealing member (not shown) can be placed in a groove formed in the inner perimeter of the holder-protruding portions 312, 314 or a groove formed in the outer perimeter of the cap-protruding portion 416.

A stepped portion 418 can be formed in the cap body 410 as needed, where the stepped portion 418 can form a step that is higher or lower than the cap body 410. In the example illustrated in FIGS. 2 and 3, the stepped portion 418 is formed at a lower position at the center of the cap body 410. The stepped portion 418 can serve to reinforce the strength of the cap body 410, and, since the pump module 500 is installed at the stepped portion 418, the relative positions of the pump module 500, the button 130, and other components can be determined by the height of the stepped portion 418.

The main side wall 422 can protrude upward by a particular length from an outer side of the cap body 410. The rim 423 can protrude outward along a horizontal direction from an upper portion of the main side wall 422, and the peripheral element 430 can protrude downward by a particular length from an outer side of the rim 423. The rim 323 of the holder 300 can be inserted in and coupled to the gap between the main side wall 422 and the peripheral element 430.

Gear teeth 476 can be formed on the outer perimeter of the peripheral element 430. The detent protrusion 176 of the shoulder 170 can be inserted in the detent groove 436 of the peripheral element 430 such that the inner cap 400 is coupled with the shoulder 170, and the gear teeth 476 of the peripheral element 430 can mate with the gear teeth on the inner perimeter of the shoulder 170 so that a rotational force applied on the shoulder 170 may be transmitted to the inner cap 400.

A female thread 438 can be formed in the inner perimeter of the peripheral element 430. The female thread 438 of the peripheral element 430 can mate with the male thread 118 on the upper portion of the outer container 110 to allow a separable coupling of the inner cap 400 to the outer container 110. A curb 425 can be formed in the peripheral element 430 as needed.

The support side wall 433 can protrude upward by a particular length from the cap body 410 and/or the rim 423. The support side wall 433 can be formed in a position corresponding to the side wall 133 of the button 130 and can support the button 130 such that the button 130 is capable of moving up and down at its designated position. For example, in the example illustrated in FIG. 3, the support side wall 433 is positioned such that the outer perimeter of the support side wall 433 contacts the inner perimeter of the side wall 133 of the button 130.

The support shaft 434 can have a cylindrical shape and can protrude upward by a particular length from the cap body 410 and/or the rim 423. The support shaft 434 can be formed at a position corresponding to the support shafts 134 of the button 130 so as to support the button 130 such that the button 130 is capable of moving up and down at its designated position. Unlike the support side wall 433, the support shaft 434 can prevent the button 130 from rotating. In the example illustrated in FIGS. 2 and 3, the button 130 and the inner cap 400 include three support shafts 134, 434 each, with the outer perimeters of the support shafts 434 of the inner cap 400 touching the inner perimeters of the support shafts 134 of the button 130. In certain other embodiments, the positions and structures of the support side wall 433 and the support shafts 434 can be changed. In particular, in cases where the support shafts 434 are provided, it would be possible to omit the support side wall 433.

The pump module 500 can be arranged adjacent to the holder channel 315 of the holder 300 and the cap channel 415 of the inner cap 400 and can be configured to dispense the content in the storage space 215 out of the dispensing hole 139 of the button 130 when the button 130 is pressed. In certain embodiments, the pump module 500 can be made from a combination of materials such as PP (polypropylene), TPE (thermoplastic elastomers), etc. Of course, however, the invention is not limited by the material of the pump module 500. Referring to FIG. 5, the pump module 500 can include a pump cylinder 510, a pump shoulder 520, a pump rod 540, an elastic member 550, a pump piston 560, and a pump valve 580.

In the pump cylinder 510, an interior space 515 may be formed that is open at the top, while an inflow hole 512 that allows communication between the inside and outside of the pump cylinder 510 may be formed in a lower portion of the pump cylinder 510. When the pump module 500 is mounted at a designated position of the inner cap 400, a lower portion of the pump cylinder 510 can be inserted into the storage space 215 of the inner container 210 as in FIG. 3, and the inflow hole 512 can provide communication between the storage space 215 of the inner container 210 and the interior space 515 of the pump cylinder 510.

A detent protrusion 516 can be formed in an upper portion of the pump cylinder 510. When the pump shoulder 520 is coupled to the pump cylinder 510, the detent protrusion 516 can be inserted into the detent groove 526 of the pump shoulder 520 to provide a secure coupling and a stronger seal between the pump cylinder 510 and the pump shoulder 520.

A flange 518 can be formed at a designated position on the outer perimeter of the pump cylinder 510. The flange 518 can be formed in a size corresponding to the inner diameter of the alignment protrusion 412 of the inner cap 400. To increase the sealing performance between the pump cylinder 510 and pump shoulder 520, it is possible to add a sealing member (not shown) between the flange 518 of the pump cylinder 510 and the peripheral element 524 of the pump shoulder 520.

The pump shoulder 520 can have a channel formed on the inside through which the pump rod 540 may pass and can be coupled to the open top of the pump cylinder 510, whereby the pump shoulder 520 can serve to seal the inside of the pump module 500 while permitting the vertical movement of the pump rod 540. The pump shoulder 520 can mainly include an inner support element 522, a rim 523, and a peripheral element 524.

The inner support element 522 of the pump shoulder 520 can have the shape of a hollow cylinder. The inner support element 522 may be the portion contacting the pump rod 540 and can form surface contact with the pump rod 540 over a particular length. As described above, the inner support element 522 can seal the interior of the pump module 500 while permitting the vertical movement of the pump rod 540. The rim 523 can protrude outward along a horizontal direction from an upper portion of the inner support element 522, and the peripheral element 524 can protrude downward by a particular length from an outer side of the rim 523. Due to this structure, a gap can be formed between the inner support element 522 and the peripheral element 524, and an upper portion of the pump cylinder 510 can be inserted in and coupled to this gap.

The rim 523 can provide a flat surface for supporting the lower end of the elastic member 550. A securing protrusion 529 can be formed around the channel on the upper surface of the rim 523, where the securing protrusion 529 can be implemented as an annular protrusion having an outer diameter corresponding to the inner diameter of the lower end of the elastic member 550. The lower end of the elastic member 550 can be coupled around the securing protrusion 529, so that the securing protrusion 529 may align the elastic member 550 in its correct position.

A detent groove 526 can be formed in the inner perimeter of the peripheral element 524, and the detent protrusion 516 of the pump cylinder 510 can be inserted in the detent groove 526 of the peripheral element 524. The detent protrusion 516 and the detent groove 526 can strengthen the coupling between the pump cylinder 510 and the pump shoulder 520 and can aid in further sealing the interior of the pump module 500.

The pump rod 540 can be structured to have the shape of a hollow cylinder with a flange 543 protruding outward from its upper portion. The lower surface of the flange 543 can contact the elastic member 550. In the lower surface of the flange 543, a coupling groove 546 can also be formed into which the upper end of the elastic member 550 may be inserted.

The top and bottom of the pump rod 540 can both be open so as to form a holding channel 545. At the top of the pump rod 540, a portion of the button 130 can be inserted into the holding channel 545 on the inside of the pump rod 540, and the dispensing channel 565 of the pump piston 560 coupled to the inside of the pump rod 540 can connect to the dispensing hole 139 of the button 130. At the bottom of the pump rod 540, portions of the pump piston 560 and pump valve 580 can be inserted into the holding channel 545 on the inside of the pump rod 540. A detent protrusion 548 can be provided on the inner perimeter of the holding channel 545 of the pump rod 540. The detent protrusion 548 can be inserted into a detent groove 568 in the pump piston 560 so that the pump rod 540 may be coupled to the pump piston 560, and as a result, the pump rod 540 and the pump piston 560 can form an integrated body that moves together.

The elastic member 550 may be positioned between the flange 543 of the pump rod 540 and the rim 523 of the pump shoulder 520 and may serve to elastically support and upward press the pump rod 540. When an external force is applied, the elastic member 550 can be elastically deformed to become compressed, and when the external force is removed, the elastic member 550 can be elastically restored to its original state. The elastic member 550 can be fabricated from a plastic material such as TPE, etc., in which case it would be possible to recycle the pump module without removing the elastic member 550.

The elastic member 550 can include flexible portions 552, where elastic deformation may occur comparatively easily, and a reinforcement rib 555, where elastic deformation does not occur easily. The reinforcement rib 555 can divide the portions where elastic deformations occur, thereby preventing non-uniform deformation as well as preventing occurrences of folding, buckling, etc., in the flexible portions 552.

The pump piston 560 can include a piston body 562 that is inserted within the pump rod 540. The piston body 562 can have the shape of a hollow cylinder such that the dispensing channel 565 is formed on the inside, while the top end of the piston body 562 can be open to allow communication with the inside of the pump rod 540. As described above, a portion of the button 130 can be inserted within the pump rod 540, and therefore the dispensing channel 565 can be connected with the dispensing hole 139 of the button 130. At a designated position in the piston body 562, an inflow hole 567 may be formed that provides communication between the outside and inside of the piston body 562. When the button 130 is pressed and the inflow hole 567 is opened, the inflow hole 567 can enable communication between the interior space 515 of the pump cylinder 510 and the dispensing channel 565.

A piston head 564 can be formed at the lower end of the piston body 562. The piston head 564 may be a portion that is formed with a diameter larger than that of the piston body 562, and when the pump piston 560 moves up, the piston head 564 may be caught on the pump valve 580 to force the pump valve 580 to move up together.

The pump valve 580 can be arranged around the outer perimeter of the piston body 562. The pump valve 580 can include a piston-coupling portion 582, a bridge 583, and a cylinder-coupling portion 584.

The piston-coupling portion 582 may be the part that tightly contacts the outer perimeter of the piston body 562 and can have a shape similar to a hollow cylinder. The piston-coupling portion 582 can usually be kept closing the inflow hole 567, but when the pump piston 560 moves down, the pump valve 580 may move down after a delay compared to the pump piston 560, thus allowing the inflow hole 567 to be opened for a particular duration of time. An upper portion of the piston-coupling portion 582 can be inserted into the gap formed between the pump rod 540 and the pump piston 560.

The bridge 583 may correspond to a connecting member between the piston-coupling portion 582 and the cylinder-coupling portion 584. When the pump piston 560 is moved down, the pump valve 580 may not immediately move down together, but as the lower end of the pump rod 540 coupled to the pump piston 560 contacts the bridge 583 and presses the bridge 583 downward, the pump valve 580 may also be made to move down together.

The cylinder-coupling portion 584 can have a diameter that is larger than that of the piston-coupling portion 582 and can be arranged around the piston-coupling portion 582. The cylinder-coupling portion 584 can also have a shape similar to a hollow cylinder, and the outer perimeter of the cylinder-coupling portion 584 can tightly contact the inner perimeter of the pump cylinder 510. Due to the friction between the cylinder-coupling portion 584 and the inner perimeter of the pump cylinder 510, the pump valve 580 can be delayed from moving downward when the pump piston 560 is moved down.

In this way, the pump valve 580 can move down after a certain delay after the downward movement of the pump piston 560, due to the friction with the inner perimeter of the pump cylinder 510. As a result, the inflow hole 567 of the pump piston 560 can be opened, and the content (not shown) that had been drawn into the interior space 515 of the pump cylinder 510 can be moved into the dispensing channel 565 of the pump piston 560. When the pump piston 560 is returned to its original position by the restoring force of the elastic member 550, the pump valve 580 can be caught by the piston head 564 and thus be moved upward together with the pump piston 560.

The button 130 can be coupled to an upper portion of the pump module 500 and can correspond to the part that is pressed by the user for the operating of the pump module 500. The dispensing hole 139 can be formed in the button 130, and the button 130 can be coupled such that the dispensing hole 139 is placed in communication with the dispensing channel 565 of the pump module 500. The button 130 can operate the pump module 500 as it is pressed by the user and moved down, and as a result, the content that had been drawn into the pump module 500 can be discharged through the dispensing hole 139. While, in certain embodiments, the button 130 can be made from a plastic material such as PP (polypropylene), etc., the invention is not limited by the material of the button 130.

The button 130 can have a slightly concave shape such that a downward gradient is formed towards the dispensing hole 139, thereby preventing the content from flowing to other places after the content is dispensed through the dispensing hole 139. Securing protrusions can also be formed on a lower surface of the button 130 to allow coupling with the pump module 500. Referring to FIG. 3, the button 130 can mainly include a connecting piece 132, a side wall 133, and the support shafts 134.

The connecting piece 132 can have the shape of a hollow cylinder and can be formed around the dispensing hole 139 of the button 130 so as to form a channel on the inside that connects to the dispensing hole 139. The connecting piece 132 can be coupled to an upper portion of the pump rod 540 of the pump module 500, so that the dispensing hole 139 may be in communication with the dispensing channel 565 of the pump rod 540.

The side wall 133 may be a part corresponding to the outer periphery of the button 130 and can extend by a length that is greater than or equal to the range of movement of the button 130. The inner perimeter of the side wall 133 can maintain contact with the outer perimeter of the support side wall 433 of the inner cap 400, thereby allowing the button 130 to move up and down at a designated position. A flange 135 can protrude outward from a lower portion of the side wall 133. The button 130 may be supported by the pump module 500, which includes the elastic member 550, and the flange 135 may be caught on the ledge 175 of the shoulder 170, so that even if the elastic member 550 pushes the button 130 upward, the button 130 may not move up beyond its designated range.

A support shaft 134 can have the shape of a hollow cylinder and can protrude downward by a particular length from a lower surface of the button 130. The support shafts 134 can be formed in positions corresponding to the support shafts 434 of the inner cap 400 in a manner that allows the button 130 to move up and down at its designated position. Although FIG. 3 illustrates an example in which the outer perimeters of the support shafts 434 of the inner cap 400 contact the inner perimeters of the support shafts 134 of the button 130, it should be apparent that the support shafts 434 of the inner cap 400 can have hollow shapes and the inner perimeters of the support shafts 434 of the inner cap 400 can contact the outer perimeters of the support shafts 134 of the button 130.

The valve 150 may be a member mounted onto the dispensing hole 139 of the button 130 and can serve to open and close the dispensing hole 139 such that the content (not shown) flows only in one direction. As illustrated in FIG. 3, the valve 150 can have a disk formed at the top and a detent part formed at the bottom, where the disk part at the top of the valve 150 can be made to close the dispensing hole 139 by the force of gravity. When the user manipulates the button 130 and the pump module 500 dispenses the content, the valve 150 can be lifted by the pressure of the content to open the dispensing hole 139, and the content can pass through the dispensing hole 139 to be discharged onto the upper surface of the button 130. Here, the detent part of the valve 150 may prevent the valve 150 from becoming detached from the dispensing hole 139. When the external force on the button 130 is removed, the valve 150 can move back down to close the dispensing hole 139 and can thus prevent the content that has been dispensed onto the upper surface of the button 130 and other foreign substances from entering the dispensing container 100 again through the dispensing hole 139.

The shoulder 170 can be coupled to the inner cap 400 to secure the button 130. A through-hole can be formed at the top of the shoulder 170, and the button 130 can be exposed to the outside through the through-hole of the shoulder 170, as illustrated in FIG. 3. In certain embodiments, the shoulder 170 can be made from a plastic material such as PP (polypropylene), etc., and can also be made from the same material as the inner container 210, holder 300, etc. Of course, however, the invention is not limited by the material of the shoulder 170. The shoulder 170 can mainly include a band portion 171 and an arch portion 172.

The band portion 171 can be configured to encompass the peripheral element 430 of the inner cap 400. A detent protrusion 176 and gear teeth can be formed on the inner perimeter of the band portion 171. The detent protrusion 176 of the shoulder 170 can be inserted into the detent groove 436 of the peripheral element 430, so that the inner cap 400 may be coupled with the shoulder 170, and the gear teeth on the inner perimeter of the shoulder 170 can mate with the gear teeth 476 of the peripheral element 430, so that a rotational force applied on the shoulder 170 may be transmitted to the inner cap 400. The outer perimeter of the band portion 171 can be exposed to the outside and can form a part of the exterior of the refillable dispensing container 100.

The arch portion 172 can be formed above the band portion 171 and can include a ledge 175 at the top that protrudes inward so as to prevent the button 130 from departing its designated position. That is, the ledge 175 can protrude inward such that a through-hole is formed on the inside that allows the button 130 to pass through, and the flange 135 of the button 130 can form a detaining part that prevents the button 130 from moving up beyond a designated height.

In the example illustrated in FIGS. 1A, 1B, 2, and 3, the band portion 171 forms a part of the exterior of the refillable dispensing container 100, and the arch portion 172 is housed within the overcap 190. To this end, the arch portion 172 can be formed with a diameter smaller than that of the band portion 171, where the difference in diameters can correspond to the thickness of the overcap 190. Due to the difference in diameter between the band portion 171 and the arch portion 172, a curb 173 can be formed in-between. When the overcap 190 is coupled, the inner perimeter of the overcap 190 can be supported by the outer perimeter of the arch portion 172, and the lower end of the overcap 190 can be supported by the curb 173. As in FIG. 3, the curb 425 formed on the inner cap 400 can be formed in a position and shape corresponding to the corner behind the curb 173 on the inner side of the shoulder 170.

One or more detent protrusions 174 can be formed on the outer perimeter of the arch portion 172. The detent protrusions 174 of the arch portion 172 can be point-shaped protrusions protruding from certain points as in the drawings or can be a line-shaped protrusion that extends along the entire or a portion of the outer perimeter. The detent protrusions 174 of the shoulder 170 can be inserted into a detent groove 194 in the overcap 190, allowing the overcap 190 to be coupled to the shoulder 170.

The shoulder 170 can thus be coupled to the inner cap 400 and can serve to secure the button 130 at its designated position. In certain embodiments, it would be possible to implement the shoulder 170 and the inner cap 400 as a single member. In such a case, the structure of the button 130 can be slightly modified for better coupling with the shoulder 170.

The overcap 190 corresponds to a cap that is placed over the button 130 and can be separably coupled to the shoulder 170. As described above, a detent groove 194 can be formed in the inner perimeter of the overcap 190 into which the detent protrusion 174 of the shoulder 170 may be inserted. When the overcap 190 is in a coupled state, the lower portion of the overcap 190 can be supported by the outer perimeter of the arch portion 172 and the curb 173 of the shoulder 170 and can be secured in the corresponding position by the detent protrusions 174. FIG. 1A illustrates the refillable dispensing container 100 with the overcap 190 coupled, whereas FIG. 1B illustrates the refillable dispensing container 100 with the overcap 190 separated for use. Although in certain embodiments the overcap 190 can be made from a plastic material such as PETG (polyethylene terephthalate glycol-modified), etc., the invention is not limited by the material of the overcap 190.

When the user wishes to use the refillable dispensing container 100, the user may first separate the overcap 190 to expose the button 130 as illustrated in FIG. 1B. The user may press the button 130, and as the button 130 is pushed down, the pump module 500 coupled to the bottom of the button 130 may be operated. As the pump rod 540 and pump piston 560 of the pump module 500 moves down, the inflow hole 567 may be opened, and the content that was in the interior space 515 of the pump cylinder 510 can pass through the inflow hole 567 and the dispensing channel 565 to be discharged at the dispensing hole 139 and provided on the upper surface of the button 130. The user can then use the content thus dispensed for its intended purpose.

When the user releases the pressure on the button 130, the pump rod 540 may be moved back up by the elastic restoring force applied by the elastic member 550 of the pump module 500, and the button 130 and the pump piston 560 coupled to the pump rod 540 may move up together. As the pump piston 560 is moved up, the inflow hole 567 may be closed by the pump valve 580. Also, as the pump piston 560 is moved up, the pressure within the interior space 515 of the pump cylinder 510 may be lowered, and the negative pressure thus created may cause the interior space 515 of the pump cylinder 510 to be replenished by the content in the storage space 215 of the inner container 210. This in turn may lower the pressure within the storage space 215 of the inner container 210, and the negative pressure created in the storage space 215 can cause the piston 220 arranged in the storage space 215 to move upward. Although air cannot enter the storage space 215, air can enter the ventilated space 217 under the piston 220 through the ventilation holes 212, making it possible for the piston 220 to move up.

As the refillable dispensing container 100 according to this embodiment is used for extended periods, the amount of content stored in the storage space 215 would gradually be decreased, and the position of the piston 220 would gradually be raised within the inner container 210. At a point where the content is almost completely depleted, the piston 220 would reach its highest point, and the piston body 222 would touch or at least be positioned very close to the holder body 310, so that the remaining content would be positioned within the recessed portion 224 of the piston 220. This structure can thus prevent wasted resources by making it possible to use up the content with almost none left over.

When the content within the inner container 210 is depleted such that the required amount of content is no longer dispensed, the user can replace the inner container 210 by using a refill container 200. A refill container 200 according to an embodiment of the invention is described below with reference to FIGS. 6, 7, 8A, and 8B.

Figure 6:
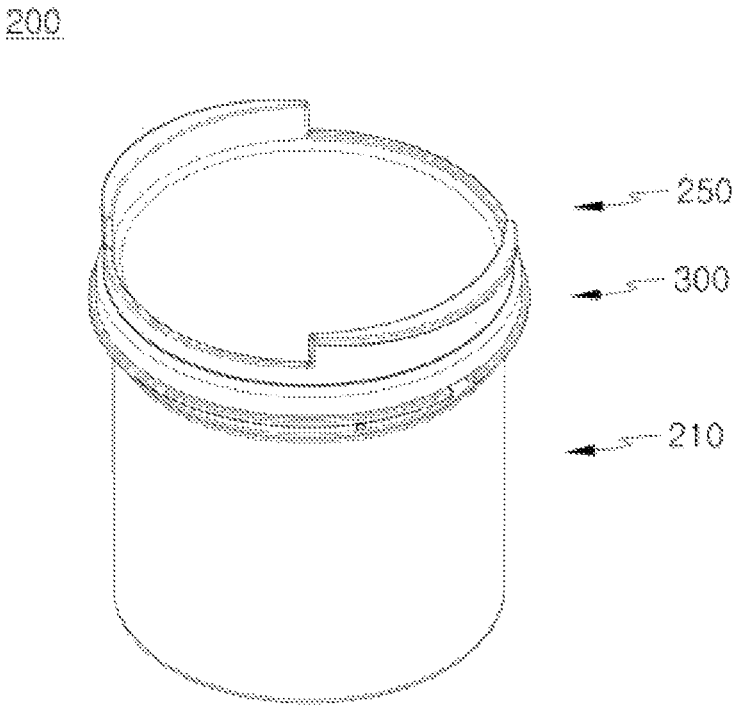
FIG. 6 is a perspective view illustrating a refill container according to an embodiment of the invention.
Figure 7:
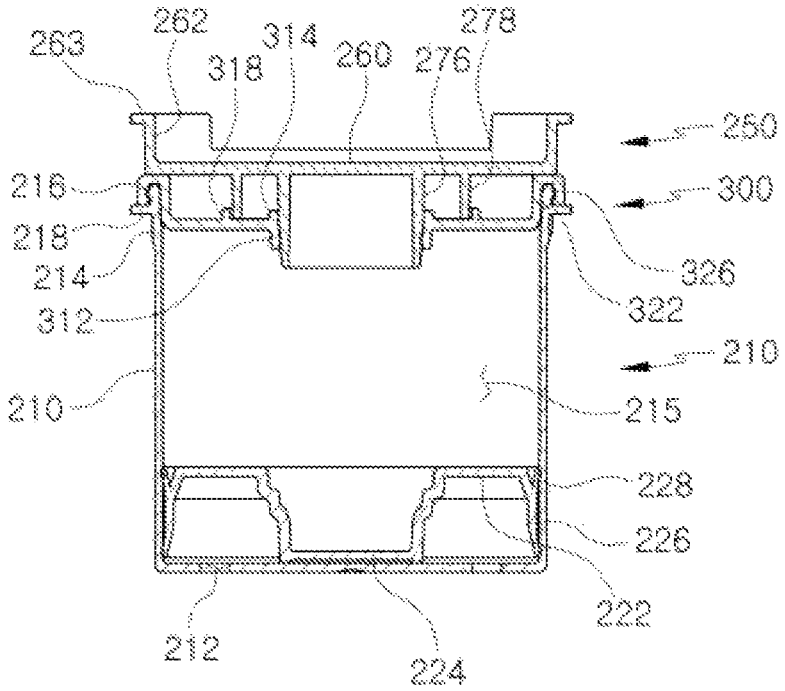
FIG. 7 is a cross-sectional view illustrating a refill container according to an embodiment of the invention.
Figure 8A:
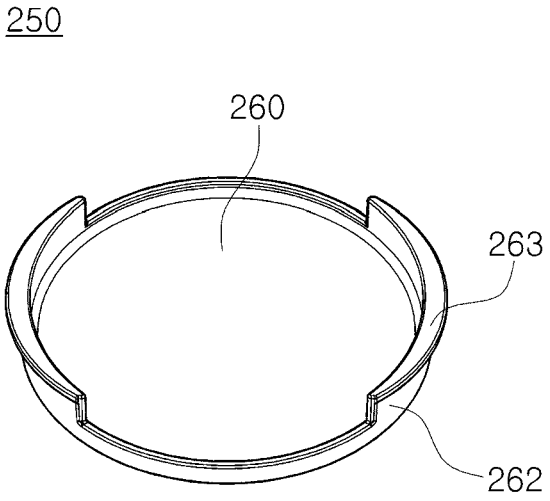
FIG. 8A and FIG. 8B are perspective views illustrating the refill cap of a refill container according to an embodiment of the invention.
Figure 8B:
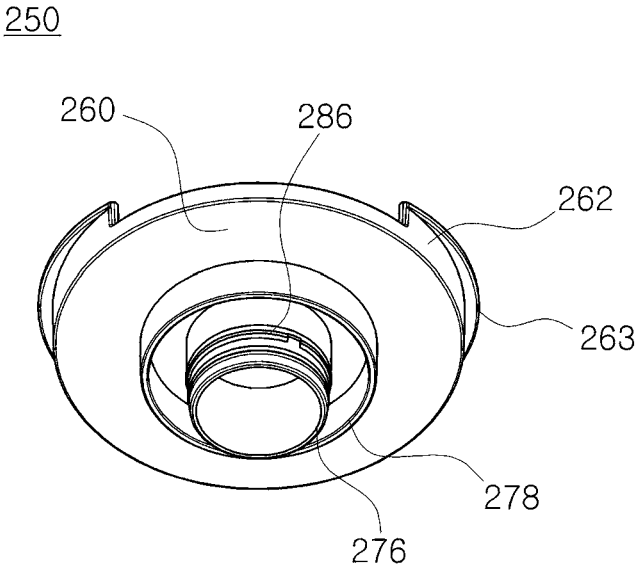

FIGS. 6 and 7 are a perspective view and a cross-sectional view, respectively, illustrating a refill container 200 according to an embodiment of the invention, while FIGS. 8A and 8B are perspective views illustrating a refill cap 250 for the refill container 200.

Referring to FIGS. 6 and 7, a refill container 200 according to an embodiment of the invention can be implemented as an assembly of the inner container 210 and the holder 300 having a refill cap 250 coupled to the assembly. For convenience, the assembly of the inner container 210 and the holder 300 is referred to as a refill unit in this specification.

The refill cap 250 can be coupled to the holder 300 in the refill container 200 and can serve to seal the holder channel 315. Referring to FIGS. 8A and 8B, the refill cap 250 can mainly include a flat element 260, grip portions 262, a first plug 276, and a second plug 278.

The flat element 260, which may form the main body of the refill cap 250, can be implemented in a generally flat shape and can have a shape corresponding to that of the holder 300. In a preferred embodiment, the diameter of the flat element 260 can be set larger than the inner diameter of the side wall 322 of the holder 300, so that when the refill cap 250 is coupled, the flat element 260 can contact the rim 323 of the holder 300, and the space on the inside of the side wall 322 of the holder 300 can be covered by the flat element 260.

The grip portions 262 can be configured to protrude upward from the edge of the flat element 260. The grip portions 262 may be protruding parts that allow the user to easily grip the refill cap 250. A flange 263 can further be provided on an upper portion of each grip portion 262 to allow the user to grip and remove the refill cap 250 more easily.

The first plug 276 can be shaped similarly to a cylinder and can protrude downward by a particular length from the lower surface of the flat element 260 at a position corresponding to the holder channel 315. In a preferred embodiment, the first plug 276 can be formed with a length that results in the lower end of the first plug 276 extending to or below the lower end of the lower holder-protruding portion 312 when the refill cap 250 is coupled to the holder 300.

Sealing protrusions 286 can be formed on the outer perimeter of the first plug 276. The sealing protrusions 286 can be more easily deformed when pressed compared to the remaining portions, thereby increasing the sealing performance of the first plug 276 and increasing the friction between the first plug 276 and the holder-protruding portions 312, 314. Although not illustrated in the drawings, there can be detent protrusions provided also on the lower end of the first plug 276, with such detent protrusions shaped to be caught on the lower end of the lower holder-protruding portion 312.

The second plug 278 can be shaped similarly to a hollow cylinder that is open at the bottom and can protrude downward by a particular length from the lower surface of the flat element 260 at a position corresponding to the support protrusion 318 of the holder 300. In a preferred embodiment, the second plug 278 can be formed in a shape that results in the lower end of the second plug 278 contacting the holder body 310 and the outer perimeter of the second plug 278 contacting the inner perimeter of the support protrusion 318 when the refill cap 250 is coupled to the holder 300.

Referring to FIG. 7, the refill cap 250 can be coupled to a refill unit, which is an assembly of the inner container 210 and the holder 300, to form a refill container 200. While the refill cap 250 is in a coupled state, the first plug 276 can be inserted through the inside of the holder-protruding portions 312, 314. Since the holder-protruding portions 312, 314 have inner diameters that decrease toward the bottom, the holder-protruding portions 312, 314 can be strongly pressed against the first plug 276, where such tight contact can serve both to seal the holder channel 315 and to provide a frictional force that prevents the refill cap 250 from becoming detached.

The second plug 278 of the refill cap 250 can be inserted to the inside of the support protrusion 318. The second plug 278 can be placed in tight contact with both the support protrusion 318 and the holder body 310 so as to form another seal. The refill cap 250 can thus provide a double seal to effectively prevent the content within the refill unit from leaking to the outside.

Next, a description is provided, with reference to FIGS. 9A to 9D, of a process for replacing the refill unit of a refillable dispensing container 100 by using a refill container 200 according to an embodiment of the invention. FIGS. 9A to 9D are perspective views that collectively illustrate a process for replacing the refill unit for a refillable dispensing container 100 according to an embodiment of the invention.

Figure 9A:
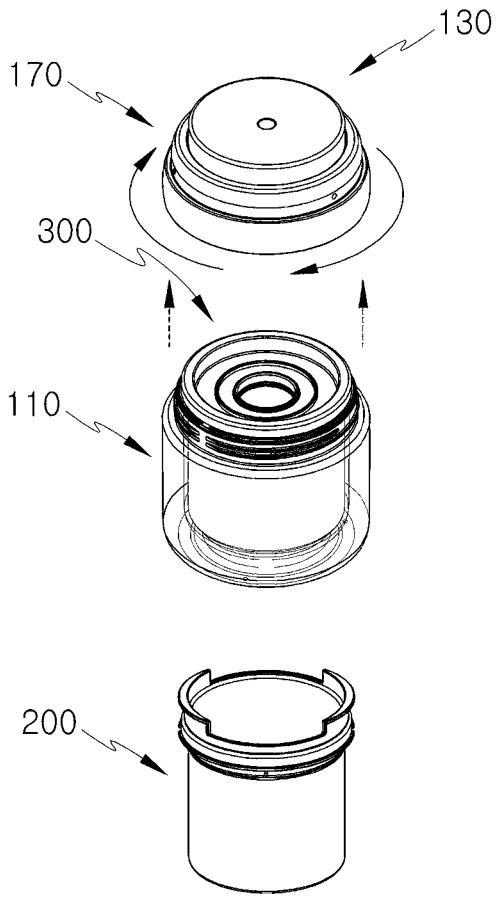
FIG. 9A, FIG. 9B, FIG. 9C, and FIG. 9D are perspective views illustrating a process of replacing the refill container in a refillable dispensing container according to an embodiment of the invention.

Referring first to FIG. 9A, after separating the overcap 190 from a refillable dispensing container 100 in which the content has been depleted, the user can rotate the shoulder 170 to separate the shoulder 170. That is, since the shoulder 170 is coupled with the inner cap 400 to form an integrated body, the user's rotating of the shoulder 170 can cause the inner cap 400 to rotate together, and the screw coupling between the inner cap 400 and the outer container 110 can be disengaged.

In the inner container 210 in which the content has been used up, the piston 220 would be at its highest position, and the pump cylinder 510 would have been inserted in the recessed portion 224 of the piston 220. Thus, in cases where the content has a certain degree of viscosity, the content can remain only in the interior space 515 of the pump cylinder 510 with very little left remaining in the inner container 210. As such, the user can immediately recycle the refill unit from which the content has been depleted. If the user wishes to clean the inside of the used refill unit before recycling, the user can insert a finger, etc., through the holder channel 315 of the holder 300 and separate the holder 300 from the inner container 210. Here, the support protrusion 318 and the holder-protruding portions 312, 314 can increase the strength of the holder body 310 and can allow the force exerted by the user to be effectively transmitted to the coupling parts of the holder 300.

Figure 9B:
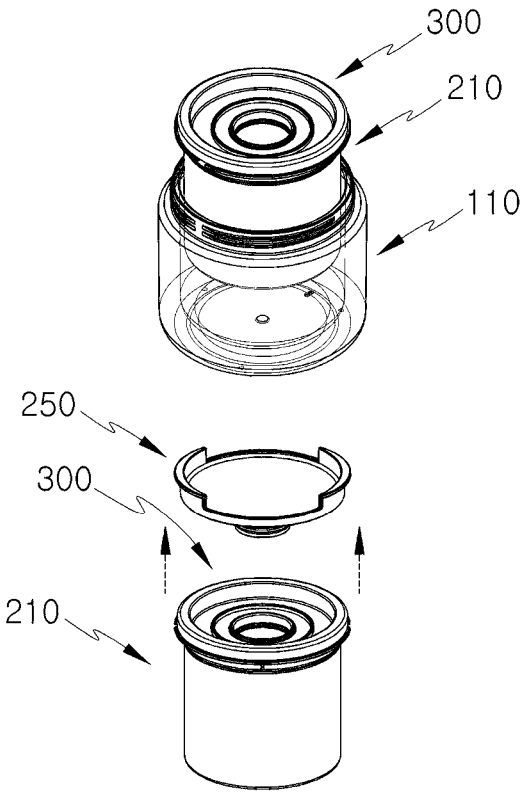

Referring to FIG. 9B, the user can pull the refill unit, which corresponds to the assembly of the inner container 210 and the holder 300, out from the outer container 110. As already described above, the inner container 210 may merely be resting on the outer container 110, and the holder 300 may not be coupled to the outer container 110 either. Therefore, when the shoulder 170 and the inner cap 400 are in a separated state, the user can separate the refill unit simply by lifting the refill unit up. In particular, since there is also a gap between the inner container 210 and the outer container 110 and there is no vacuum formed, the refill unit can be separated with relative ease.

Meanwhile, the user can separate the refill cap 250 from the refill container 200. Here, while the user can separate the refill cap 250 from the refill unit by holding the grip portions 262 and/or flanges 263 of the refill cap 250 and applying a force greater than the frictional force generated between the first plug 276 and the holder-protruding portions 312, 314, the user can also decrease the frictional force by holding and pushing the grip portions 262 toward each other to deform portions of the refill cap 250 such that a portion of the first plug 276 no longer contacts the holder-protruding portions 312, 314.

Figure 9C:
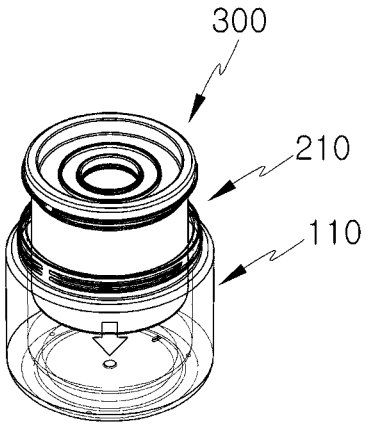

Referring to FIG. 9C, the user can insert the refill unit of the new refill container 200, from which the refill cap 250 has been separated, into the outer container 110, from which the refill unit with depleted content has been removed. In a similar manner to the removing of the refill unit, the inner container 210 of the new refill unit can have an outer diameter that is smaller than the inner diameter of the outer container 110 and thus can be inserted easily. The flange 218 of the inner container 210 of the refill unit can be inserted onto the L-shaped curb 114 of the outer container 110, so that the inner container 210 may be aligned at its proper position.

Figure 9D:
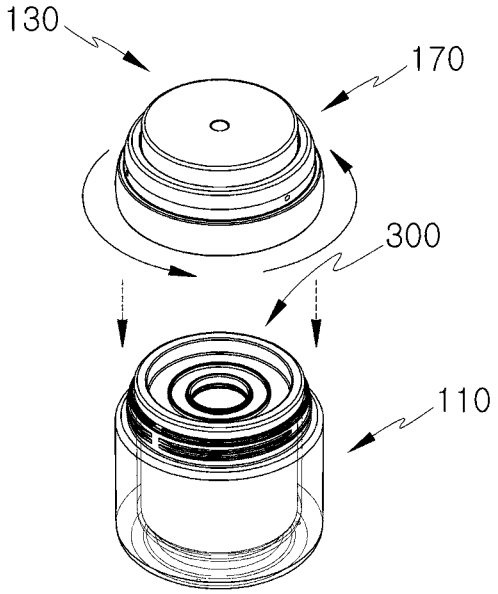

Referring to FIG. 9D, the user can couple the shoulder 170 and the inner cap 400 onto the outer container 110 in which the new refill unit has been inserted. That is, the user can rotate the shoulder 170 to form a screw coupling between the female thread 438 of the inner cap 400 and the male thread 118 of the outer container 110. The user can rotate the shoulder 170 until the lower ends of the band portion 171 and the peripheral element 430 are placed on the curb 113 of the outer container 110.

Referring again to FIG. 3, if the support protrusion 318 and the upper holder-protruding portion 314 were not provided on the upper surface of the holder 300, there would be a risk of the air between the inner cap 400 and the holder 300 being forced through the holder channel 315 to the interior of the storage space 215 when the shoulder 170 and the inner cap 400 are coupled again to the outer container 110. Air in the storage space 215 can cause uneven dispensing of the content and can hinder the upward movement of the piston 220. However, if a support protrusion 318 and an upper holder-protruding portion 314 are provided on the upper surface of the holder 300 as in an embodiment of the invention, a distance can be maintained between the inner cap 400 and the holder 300, and this can prevent air from being forced through the holder channel 315 into the storage space 215.

Also, since the cap-protruding portion 416 is inserted through the inside of the holder-protruding portions 312, 314 while the pump module 500 is in turn inserted through the inside of the cap-protruding portion 416 itself, a very strong seal can be formed between the pump cylinder 510, the cap-protruding portion 416, and the holder-protruding portions 312, 314. Furthermore, the main side wall 422, rim 423, and peripheral element 430 on the edge of the inner cap 400 can both surround the side wall 322, rim 323, and peripheral element 324 of the holder 300 and at the same time press the holder 300 against the inner container 210 by pressing down on the rim 323, so that a very strong seal can be formed at portions corresponding to the coupling part between the inner container 210 and the holder 300. Such structure of the holder 300 and inner cap 400 can strengthen the sealing performance of the inner container 210, making it possible to more easily maintain the vacuum state of the storage space 215 and thereby improving the performance of the pump module 500.

Thus, the refillable dispensing container 100 and the refill container 200 according to an embodiment of the invention can enable a very easy replacing of the refill unit and can also allow the refillable dispensing container 100 to maintain a high performance after the replacing. Also, the refillable dispensing container 100 and the refill container 200 according to an embodiment of the invention can minimize the amount of unused content remaining and can allow an easy cleaning of the inner container 210 when needed.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A refillable dispensing container comprising:

an outer container having an open top and a holding space formed therein;

an inner container having an open top and a storage space formed therein, the inner container configured to be inserted within the holding space;

a holder comprising a holder body and a support protrusion, the holder coupled to the open top of the inner container, the holder body having a holder channel formed therein, the holder channel vertically penetrating the holder body, the support protrusion protruding upward from an upper surface of the holder body;

an inner cap having a cap channel formed therein and configured to be detachably coupled to the open top of the outer container, the cap channel vertically penetrating the inner cap and formed in a position corresponding to the holder channel, the inner cap configured to press the holder against the inner container while the inner cap is coupled to the outer container;

a shoulder having a through-hole formed in an upper portion thereof, the shoulder coupled to an outer side of the inner cap;

a button having a dispensing hole formed in an upper portion thereof, the button coupled to the through-hole of the shoulder such that the button is movable along a vertical direction and a portion of the button passes through the through-hole; and a pump module arranged adjacently to the holder channel and the cap channel, the pump module including an elastic member to elastically support the button in relation to the inner cap, the pump module configured to dispense a content stored in the storage space out of the dispensing hole when the button is pressed.

2. The refillable dispensing container of claim 1, wherein the holder comprises a holder-protruding portion protruding in at least one of an upward and a downward direction from the holder body to form the holder channel therein, and an inner diameter of the holder-protruding portion decreases towards a bottom of the holder-protruding portion.

3. The refillable dispensing container of claim 1, wherein the inner cap comprises a cap-protruding portion protruding in at least one of an upward and a downward direction from a cap body to form the cap channel therein, and an inner diameter of the cap-protruding portion decreases towards a bottom of the cap-protruding portion.

4. The refillable dispensing container of claim 1, further comprising a piston arranged under the content within the storage space of the inner container, the piston configured to contact an inner perimeter of the inner cap in a watertight manner, wherein the piston moves upward within the storage space as the content is dispensed.

5. The refillable dispensing container of claim 4, wherein the piston comprises:

a piston body;

a recessed portion recessed downward from the piston body; and a contact portion formed on an outer perimeter of the piston body, and the recessed portion has a shape corresponding to portions of the holder, the inner cap, and the pump module protruding below a lower surface of the holder body.

6. The refillable dispensing container of claim 1, wherein the inner container comprises a flange configured to rest on an upper portion of the outer container, and an outer perimeter and a lower surface of the inner container do not contact the outer container.

7. The refillable dispensing container of claim 6, wherein a curb is formed on an inner side of an upper end of the outer container, and the flange of the inner container rests on the curb such that a lower surface and an outer perimeter of the flange contact the outer container.

8. A refill container for the refillable dispensing container of claim 1, comprising:

the inner container;

the holder; and a refill cap configured to be coupled to the holder, wherein the refill cap comprises:

a flat plate having a shape corresponding to the holder;

a first plug protruding downward from a lower surface of the flat plate at a position corresponding to the holder channel so as to block the holder channel while the refill cap is coupled to the holder;

a second plug protruding downward from the lower surface of the flat plate at a position adjacent to the support protrusion of the holder so as to contact a side surface of the support protrusion while the refill cap is coupled to the holder; and a grip portion protruding upward from an upper surface of the flat plate.

* * * * *